US009458590B2

(12) United States Patent
Waters, Jr.

(10) Patent No.: US 9,458,590 B2
(45) Date of Patent: Oct. 4, 2016

(54) SELF-ACTUATING FLOODWATER BARRIER

(71) Applicant: Floodbreak, LLC., Houston, TX (US)

(72) Inventor: Louis A. Waters, Jr., Bellaire, TX (US)

(73) Assignee: Floodbreak, LLC, Houston, TX (US)

( * ) Notice: Subject to any disclaimer, the term of this patent is extended or adjusted under 35 U.S.C. 154(b) by 110 days.

(21) Appl. No.: 14/373,415

(22) PCT Filed: Feb. 4, 2013

(86) PCT No.: PCT/US2013/024579

§ 371 (c)(1),
(2) Date: Jul. 21, 2014

(87) PCT Pub. No.: WO2013/119491

PCT Pub. Date: Aug. 15, 2013

(65) Prior Publication Data

US 2014/0369754 A1 Dec. 18, 2014

Related U.S. Application Data

(60) Provisional application No. 61/596,293, filed on Feb. 8, 2012.

(51) Int. Cl.

| | |
|---|---|
| ***E02B 7/50*** | (2006.01) |
| ***E02B 3/10*** | (2006.01) |
| ***E02B 7/20*** | (2006.01) |

(52) U.S. Cl.

CPC ..... *E02B 7/50* (2013.01); *E02B 3/104* (2013.01); *E02B 7/205* (2013.01)

(58) Field of Classification Search

CPC ..... E02B 3/104; E02B 7/205; E02B 7/50; E02B 7/44; E02B 7/26; E02B 7/28; E02B 7/54; E02B 7/46; E02B 2009/007; E04H 9/145

See application file for complete search history.

(56) References Cited

U.S. PATENT DOCUMENTS 4,146,346 A 3/1979 Salo
4,377,352 A 3/1983 Goodstein (Continued)

FOREIGN PATENT DOCUMENTS

GB WO2006/120410 A1 11/2006

OTHER PUBLICATIONS

Notification of Transmittal of International Preliminary Report on Patentability, International Preliminary Report on Patentability with Annexes: Amended Sheets 17-23 (amended claims), Amendments Under Rule 34 and Letter Accompanying Amendments Under Rule 34.

*Primary Examiner* — Frederick L Lagman
*Assistant Examiner* — Carib Oquendo
(74) *Attorney, Agent, or Firm* — Tim L. Burgess, P.C.

(57) ABSTRACT

A floodwater barrier for protecting the shore side of a shoreline from flooding includes at least one self-actuating floodwater barrier unit for installation between a pair of walls transverse to a shoreline. The unit includes a flexible resilient panel, a plurality of rigid members connected to the panel, at least one watertight chamber of size and arrangement to give the unit water buoyancy, hinged to be rotatable upward about a horizontal axis longitudinal to the shoreline under the influence of buoyancy and hydrostatic pressure from a rise of the body of water acting on the unit, and further includes flexible tension members positioned to act on the floodwater barrier unit to limit upward rotation of the unit to a predetermined extent.

47 Claims, 9 Drawing Sheets

(56) References Cited

U.S. PATENT DOCUMENTS

| | | | |
|---|---|---|---|
| 5,483,913 | A | 1/1996 | Ohkawa |
| 6,216,399 | B1 | 4/2001 | Belarbi |
| 6,623,209 | B1 | 9/2003 | Waters, Jr. |
| 7,121,764 | B2 | 10/2006 | Rorheim |
| 7,435,036 | B2 | 10/2008 | Cullen |
| 7,658,572 | B2 | 2/2010 | Miyao |

SELF-ACTUATING FLOODWATER BARRIER

CROSS-REFERENCE TO RELATED APPLICATIONS

This application claims the benefit of the filing date of U.S. Provisional Patent Application No. 61/596,293, filed Feb. 8, 2012, the disclosures of which are incorporated by reference.

STATEMENT REGARDING FEDERALLY SPONSORED RESEARCH AND DEVELOPMENT

Not Applicable

BACKGROUND OF THE DISCLOSURE

1. Field of Disclosure

This invention relates to barriers for protecting shorelines from floodwaters, especially floodwaters prone to wave action.

2. Background

Floodwaters are a major source of property damage. Floodwaters may come from a rising body of water, such as a hurricane driven storm surge, from swollen rivers rising above flood stage from snow melt or heavy rains, or from waters accumulating and rising at ground surface due to sustained rains overwhelming drainage systems. Improved coastal, tidal and riverine areas often employ a shoreline water barrier such as a bulkhead, seawall, dike or levee, to prevent destruction of water front properties by flooding from rising water. Buildings on the shore of a place for a body of water are especially vulnerable to wind driven floodwaters overtopping water barriers.

Steel or concrete walls permanently installed atop water barriers, offer a potential solution for prevent rising water and wind driven waves from overtopping water barriers and damaging or destroying waterfront properties. However, permanent walls along a shoreline tall enough to block overtopping waters and withstand pounding wave action may obscure the view of the waterscape, mar the landscape of often beautiful coastline and riverine areas, and impede recreational use of beaches and shorelines.

Solutions that do not permanently block the view of the waterscape of the place for a body of water lined by the bulkhead, seawall, levee, dike or other shoreline water barrier construction have been proposed. For example, see U.S. Pat. No. 6,338,594 (vertically elevating buoyant walls from an underground chamber into which water is pumped to float the walls upwardly); U.S. Pat. Nos. 5,725,326 and 7,744,310 (use of rising storm waters to fill underground chambers and buoy walls vertically upwardly atop a dike or bulkhead); U.S. Pat. No. 7,033,122 (folded metal wall situated in an accommodation space in a dike that can be unfolded and locked in place by workers). However, these solutions depend upon an available workforce or power to run pumps or upon underground structures susceptible to fouling from accretion of surface materials. Natural riverbanks (that is, not bulkheaded) that are lined by self-elevating stanchions interconnected by sheeting are described in U.S. Pat. No. 4,377,352. The inventor of possible embodiments of the invention described herein has disclosed in U.S. Pat. No. 6,623,209 a system by which doors and other grade level openings are guarded from entrance of water by water buoyant rigid flood barrier panels that are self-actuating.

Aluminum alloys are suitable for use as rigid panels for a self-actuating water buoyant flood barrier, especially in a marine environment, for they are relatively lightweight, corrosion resistant, readily available, and cost effective, and are a material of choice where the self-actuating gate must be load bearing for vehicular or pedestrian traffic. A risen panel of a self-actuating water buoyant flood barrier is held upright by hydrostatic pressure of risen water pressing against it, and is subject to flexural stress, that is, stress normal to the plane of the panel, which tends to bend the panel toward the center of the panel. Rising levels of water steadily and increasingly stress the panel from hydrostatic pressure acting on it. Creeping rises of water levels present little problem of durability for a well-engineered aluminum alloy. A structural limitation of aluminum alloys is, however, their fatigue strength and fatigue limit. Fatigue strength is the stress at which failure occurs for a given number of cycles. Fatigue limit is the load ceiling below which a material will not fail, regardless of the number of cycles of load below that ceiling it is subjected to. Aluminum alloys have no well-defined fatigue limit, meaning that fatigue failure eventually occurs after many cycles, depending on the grade of alloy, even under very small cyclic loadings. However, floodwater storm waves intermittently arriving and crashing onto the panel on top of a risen water level suddenly and cyclically impart massively large loads on a risen panel, steeply increasing stress of the panel more intensely than the comparatively steady force applied from the more slowly changing level of rising or falling water. Cycling pressure spikes from storm waves repetitively crashing onto a rigid aluminum panel over time and from storm to storm hasten the possibility of eventual fatigue and failure of an aluminum alloy panel and other like rigid panels formed of a material suitable for use as a self-actuating water buoyant flood barrier, especially in a corrosive marine environment. This necessitates repair or replacement of the flood barrier. An improvement in this situation is desirable.

BRIEF DESCRIPTION OF THE DRAWINGS

In the following detailed description of exemplary embodiments, reference is made to the accompanying drawings, which form a part hereof and in which are shown by way of illustration examples of exemplary embodiments with which the invention may be practiced. In the drawings and descriptions, like or corresponding parts are marked throughout the specification and drawings with the same reference numerals. The drawings are not necessarily to scale. Certain features of the invention may be shown exaggerated in scale or in somewhat symbolic or schematic form and some details of conventional elements may not be shown in the interest of clarity and conciseness. Referring to the drawings.

DETAILED DESCRIPTION OF EMBODIMENTS

Figure 1:
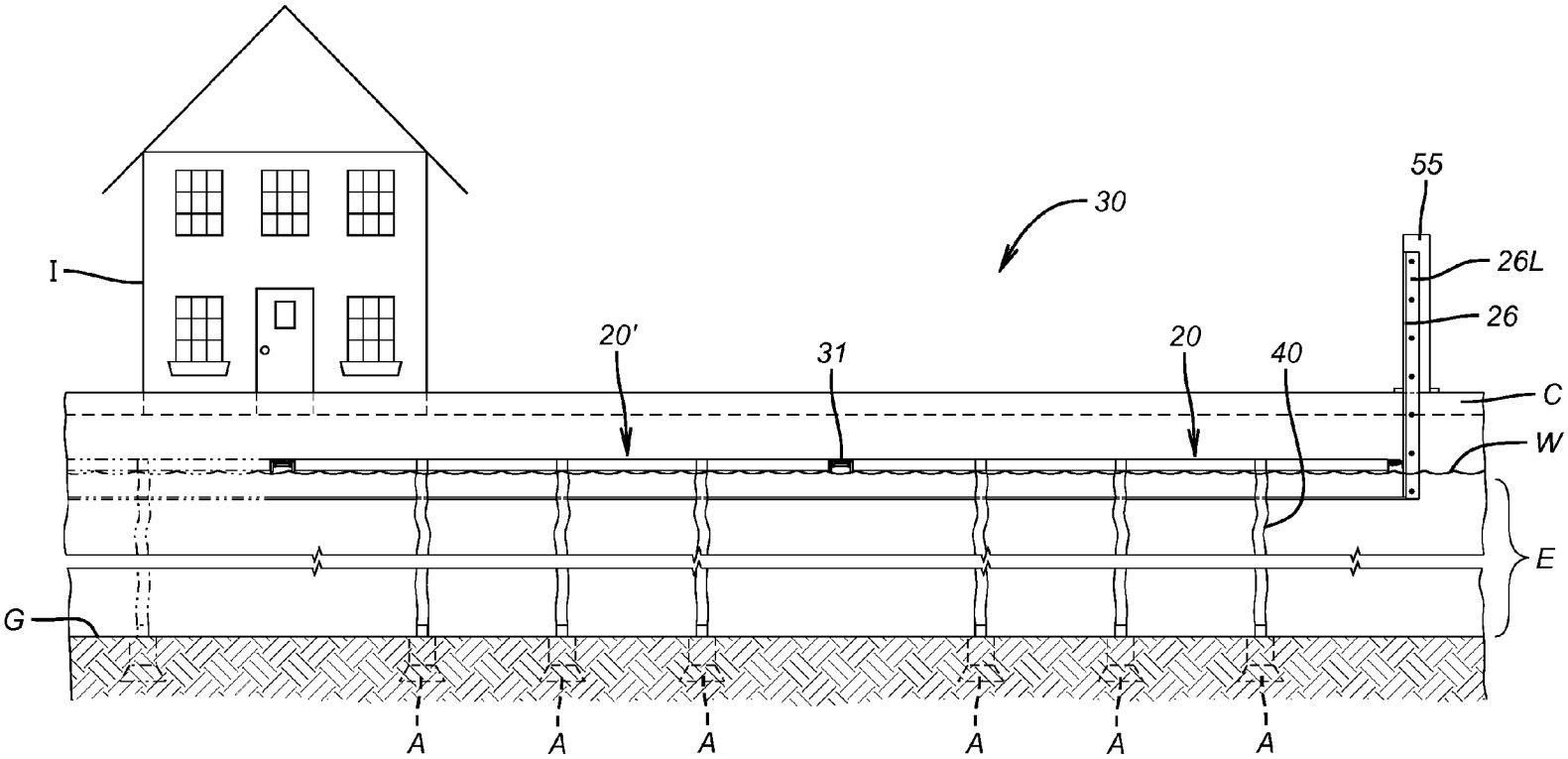
FIG. 1 is an elevational view of an exemplary embodiment of floodwater barrier modules fashioned from floodwater barrier units of the invention, assembled as a floodwater barrier, and installed adjacent a water barrier construction in the form of a bulkhead along a shoreline of a body of water. In this view the floodwater barrier floats on a body of water on the waterside of the bulkhead. A symbolic house in FIG. 1 signifies an on-shore improvement guarded by the floodwater barrier of FIG. 1.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" in various places throughout this specification are not necessarily all referring to the same embodiment. Furthermore, the particular features, structures, or characteristics may be combined in any suitable manner in one or more embodiments. It will be seen that various changes and alternatives to the specific described embodiments and the details of those embodiments may be made within the scope of the invention. It will be appreciated that one or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "top", "lower," "bottom", "back," "front," "transverse," "perpendicular", "vertical", "normal," "horizontal," "length," "width," "laterally" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify.

As used herein, the use of the word "a" or "an" when used in conjunction with the term "comprising" (or the synonymous open ended "having" or "including") in the claims and/or the specification may mean "one," but it is also consistent with the meaning of "at least one" and "one or more than one."

In addition, as used herein, the phrase "connected" means joined to or placed into communication with, either directly or through intermediate components. The word "ground" means a surface or earthen floor to which an improvement is constructed. A "body of water," may be a stream, a canal, a river, a pond, a lake, a bayou, a lagoon, an estuary, a bay or an ocean, for example. A "place for a body of water" signifies a place that a body of water occupies or can normally occupy including, in addition to the bed of any of the mentioned bodies of water near a shoreline normally occupied by the body of water, also a tidal flat or mud flat that is periodically submerged according to tidal flows. A "construction" may be any improvement built on or in the earth. In some embodiments described herein, the exemplified construction, without limitation, is a structure, for example a bulkhead, lining a shoreline of a place for a body of water, the normally exposed parts of the construction being spaced from and anchored in ground on the water side of the bulkhead, potentially unexposed parts of which may be below ground or normally inundated by a normal level of a body of water (if tide water, except perhaps at low tide). In other embodiments disclosed herein, the construction is a formation raised along a shoreline, such as a levee or seawall.

In accordance with this invention, a buoyant flexible resilient panel is employed in a self-actuating floodwater barrier unit instead of a rigid panel or a non-buoyant merely flexible panel. The self-actuating floodwater barrier unit is adapted for installation along a shoreline adjacent a place for a body of water, between a pair of walls transverse to the shoreline.

Resilience is the property of a material to absorb stress when it is deformed elastically and then, upon unloading, to have this energy recovered. The use of a flexible and resilient panel, as in the described exemplified embodiments of the invention, allows a self-actuating water buoyant water barrier to better withstand spiking stress load cycles from wave action, or swells, over an extended period of time, without suffering fatigue and failure as much or as soon as rigid panels otherwise suitable for use in a self-actuating floodwater barrier, especially in a marine environment. Where a self-actuating water barrier does not have to be load bearing for vehicular or pedestrian traffic adjacent a shoreline exposed to wave action overtopping a static water barrier construction on the shoreline, a flexible and resilient panel in accordance with this invention has advantages of reduced operational costs.

In accordance with this invention, if the material of a buoyant flexible panel is such as to make it flexible but not resiliently elastically deformable, resilience may be provided to the panel by inclusion of resilient flexible stringers supporting the panel arranged transversely to and connecting to elongate rigid attachment members at or adjacent the lateral ends of the panel. The stringers may be embedded in the material of the buoyant flexible panel or fitted into sleeves formed in the material of the panel. In an exemplary embodiment, the resiliently flexible stringers may be a fiber-reinforced polymer composite or spring steel. The fiber-reinforced polymer composite may comprise glass fiber, para-aramid synthetic fiber, aluminum fiber, carbon fiber, or combinations thereof. The polymer of the composite may be epoxy, polyester, vinyl ester or nylon or other suitable polymer resin. Fiber-reinforced composites are strong and light and can be tailored for a desired degree of resilient flexibility.

Alternatively, the material of the panel may be flexible and resiliently elastically deformable and the panel may have no resilient flexible stringers. In an exemplary embodiment the buoyant flexible resilient panel of a floodwater barrier unit is formed of a resiliently elastically deformable material. As an exemplary embodiment, a buoyant flexible resiliently elastically deformable panel may comprise a relatively water impervious thermoplastic elastomer (for example, a polyester elastomer resin), a rubber composition, an elastomeric laminate material or a combination or composite of two or more of them. The desired properties are flexibility, resilience and mechanical strength with a high flexural modulus (the ratio of stress to strain in flexural deformation, i.e., the tendency for a material to bend).

Or, the resilience of the buoyant flexible resilient panel may be provided from both the nature of the material of the panel and a plurality of resilient flexible stringers supporting the panel.

In an exemplary embodiment of this invention, a self-actuating floodwater barrier unit comprises a panel assembly comprising a flexible resilient panel and a plurality of rigid attachment members connected to the panel. The panel comprises one or more watertight chambers of size and arrangement to give the unit water buoyancy. A flexible resilient chambered panel is herein sometimes called a "buoyant flexible resilient panel." In an exemplary embodiment, one or more of the chambers may be compartmentalized to maintain buoyancy if a chamber's water tightness is compromised.

The resilient flexible stringers are not constrained to any particular shape, and may, for example, be a rod, a strip, a band, may be circular, ellipsoidal, a rectilinear polygon, a polyhedral, symmetrical or asymmetrical in cross section, or be uniform or tapered along its length or thicker at ends than in the center, or may have any number of other shapes and dimensions so long as it is longitudinal, serves the function of a beam to distribute bending forces laterally along its length, and is flexible and resilient. The composition, selection of shape and dimension will be tailored to the dimensions and material of the particular flexible or flexible and resiliently elastically deformable material used for a buoyant panel.

An exemplary embodiment of a self-actuating floodwater barrier unit comprising such a panel assembly further comprises pivotation members including a stationary member for anchorage adjacent the shoreline and a movable member connected to a mentioned rigid attachment member on a lower portion of the panel assembly, the movable member being movably joined to the stationary member and pivotally rotatable upward from a normally horizontal disposition of the flexible resilient panel about an axis longitudinal with the shoreline under the influence of water buoyancy and hydrostatic pressure from a rise of the body of water. This axis hereinafter is sometimes called the "pivotation axis."

An exemplary embodiment of a self-actuating floodwater barrier unit comprising such a panel assembly further comprises at least one flexible tension member connected at one end to an anchorage lower than the panel assembly when the panel assembly is horizontally disposed and at the other end connected to a rigid attachment member at a portion of the panel assembly effective on tensioning of the tension member to limit upward rotation of the panel assembly to a predetermined extent. This extent will be determined for the particular installation at a particular site. Normally the flexible tension members will work to prevent panel rotation past vertical but there may be site variables that suggest a different extent.

In an exemplary embodiment of a self-actuating floodwater barrier unit comprising such a panel assembly, the rigid attachment members of the panel assembly may include at least one elongate rigid attachment member transverse to the pivotation axis about which the buoyant flexible resilient panel rotates upwardly.

In an exemplary embodiment, the flexible resilient panel is supported between two elongate rigid attachment members. In an exemplary embodiment, a flexible panel is supported between two elongate rigid attachment members by a plurality of resilient flexible stringers arranged transversely to and connecting to the elongate rigid attachment members. In an exemplary embodiment, an elongate rigid attachment member cooperating with another such member of the two members supporting the flexible panel also attaches a plurality of resilient flexible stringers of a laterally adjacent like floodwater barrier unit, in so doing, cooperating with a elongate rigid attachment member of that adjacent like unit to support the flexible panel of that adjacent like unit. This arrangement (an elongate rigid attachment member attaching a plurality of resilient flexible stringers of laterally adjacent flexible panels) may be repeated by a plurality of elongate rigid attachment members cooperating with another adjacent such member to support a plurality of flexible panels between them. As mentioned above, the resilient stringers can provide the needed resilience to a flexible panel or the stringers can also be used in flexible resiliently elastically deformable panel.

In an exemplary embodiment, one or more elongate rigid attachment members may serve for attachment of a movable member of the above mentioned pivotation members. Elongate rigid attachment members to which movable members of pivotation members attach for upward rotation may also have watertight chambers of size and arrangement effective to impart additional water buoyancy to the floodwater barrier unit, and these chambers may be compartmentalized. Thus, in an exemplary embodiment, elongate rigid members to which movable members of pivotation members attach for upward rotation of a floodwater barrier unit may be hollow and sized relative to the width and weight of the panel to contribute a degree of buoyance tailored to tradeoffs (such as shorter or longer panels) at the particular site of an installation.

In an exemplary embodiment, another elongate rigid attachment member not serving for attachment of a movable member of pivotation members may be an elongate hardpoint fixed at a lateral side of the buoyant flexible resilient panel for attachment of connectors for connecting adjacent floodwater barrier units side by side. It will be understood when speaking of elongate hardpoints that they are included in the rigid attachment members included in the panel assembly.

Such a lateral elongate hardpoint may attach a gasket for wipe sealing a gap between the so fixed elongate hardpoint and an adjacent wall that is transverse to the shoreline. Thus, in an exemplary embodiment, a floodwater barrier unit comprising a buoyant flexible resilient panel may include, at a lateral elongate hardpoint not connected to another floodwater barrier unit, a gasket mounted on the hardpoint and positioned to wipe seal an adjacent wall transverse to the pivotation axis of rise on rise of the panel of the unit from horizontal, to restrain passage of water between the floodwater barrier unit and the wall when the unit pivots upwardly on the pivotation axis.

A lateral elongate exemplary hardpoint also may attach a plurality of resilient flexible stringers in cooperation with an elongate rigid attachment member that is not a hardpoint.

In another exemplary embodiment, rigid attachment members of a panel assembly may include hardpoints in the buoyant flexible resilient panel that are not the elongate hardpoint fixed at a lateral side of the panel; some of these hardpoints in the buoyant flexible resilient panel that are not the elongate hardpoint fixed at a lateral side of the panel serve for attachment of flexible tension members limiting rotation of the buoyant flexible resilient panel and some serve for attachment of a movable member of pivotation members.

A buoyant flexible resilient panel may be a composite of several flexible and resilient panel members united to disallow flow of water between the members. In an exemplary embodiment the panel of a floodwater barrier unit comprises a plurality of closed end, longitudinal elastomeric tubes arranged generally parallel to the pivotation axis of rotation of the panel and united to disallow passage of water between the tubes. In an exemplary embodiment, the chambers of resiliently elastically deformable panels of floodwater barrier units may be compartmentalized. In an exemplary embodiment, resiliently flexible stringers may be embedded in the resiliently elastically deformable material of the panel or may be fitted into sleeves fashioned in the resiliently elastically deformable material.

In another exemplary embodiment the flexible resilient panel of the floodwater barrier unit comprises a bladder compartmentalized into a plurality of watertight chambers and encased in a sealed envelope of wear resistant material such as a durable Kevlar® mesh in order to prevent punctures, and in the case of a Kevlar® mesh also being somewhat water resistant. In an exemplary embodiment, resiliently flexible stringers may be embedded in the bladder or may be fitted into sleeves fashioned in the envelope.

Floodwater barrier units may be assembled side-by-side to build up a desired length of a floodwater barrier for installation between end or intermediate walls transverse to the shoreline. The floodwater barrier units may be assembled by connecting the units side by side at an elongate hardpoint fixed at a lateral side of the flexible panel. Or, the buoyant flexible resilient panels of floodwater barrier units may be longitudinally lengthy. As such, side-by-side assembly of floodwater barrier units to form a longer floodwater barrier may be un-necessary for a particular installation. The basic structure and nature of a floodwater barrier unit comprising a buoyant flexible resilient panel provides engineering tools allowing adaptation of the structure of the floodwater barrier unit to the demands of a particular site for installation.

An exemplary embodiment of an installation for preventing flooding of a shore along a shoreline adjacent a place for a body of water due to a flooding rise of the water comprises a pair of walls transverse to the shoreline and a floodwater barrier unit between the pair of walls comprising the panel assembly, the pivotation members and the flexible tension members. In this context, the indefinite article "a" in the words "a floodwater barrier unit" is the equivalent of "at least one," and so comprehends the singular and the plural. Thus "a floodwater barrier unit" may include a plurality of such units, in an exemplary embodiment, with elongate rigid attachment members attaching resilient flexible stringers of laterally adjacent flexible or flexible and resilient panels, to support panels between such members, the plurality of units building up to form a module which can be connected to another module, and potentially according to requirements at a particular site, that module connected to another, and so on, to form an assembly of connected modules that provide a floodwater barrier for installation between a pair of walls transverse to the shoreline. The words "a floodwater barrier unit" may also includes a single unit, in an exemplary embodiment, a longitudinally lengthy unit that alone serves as a module that can be connected with another such module, and potentially according to requirements at a particular site, that module connected to another, and so on, to form an assembly of connected modules to form an assembly of such modules to provide a floodwater barrier for installation between a pair of walls transverse to the shoreline. Sometimes herein, an assembly of connected modules, whether formed from one floodwater barrier unit or a plurality of floodwater barrier units, is for brevity called a "floodwater barrier assembly."

In an exemplary embodiment of an installation making use of a floodwater barrier unit, the installation may be one in which a floodwater barrier unit or a floodwater barrier assembly is arranged to float substantially horizontally disposed on a body of water at the normal level of the water body. For example, in the case of tidal water the normal level may be the mean tidal level between high tide and low tide, and for waters not subject to tidal fluctuations in elevation, the normal level may be a typical non-flood stage level.

In another exemplary embodiment of an installation making use of a floodwater barrier unit, the floodwater barrier unit or a floodwater barrier assembly may be arranged to reside on-shore normally (in non-flooding conditions) horizontally disposed in a recess in a formation on the shore along and adjacent the shoreline.

In either kind of installation, on-shore or on water, one wall of a pair of end walls provides a first end wall to a floodwater barrier unit or a floodwater barrier assembly. Another wall of the pair of end walls provides a second end wall to a floodwater barrier unit or a floodwater barrier assembly. A main purpose for a pair of end walls is to prevent a passage of floodwaters around the ends of the water barrier created by a raised floodwater barrier unit or a floodwater barrier assembly, thereby keeping potential flooding waters contained in front of a risen floodwater barrier unit, or a floodwater barrier assembly. Thus the two end walls have a height at least about as tall as the height of an erect floodwater barrier unit or floodwater barrier assembly, for preventing floodwaters—risen as high as the fully erect height of the floodwater barrier unit or connected such units—from flowing around the upper portions of the lateral sides of the erect floodwater barrier unit or floodwater barrier assembly.

Between the end walls may be one or more additional walls transverse to the shoreline. These additional walls would have floodwater barrier units or a floodwater barrier assembly on both sides. A first floodwater barrier unit or a floodwater barrier assembly may be located between the first end wall and a next adjacent additional wall, and a second floodwater barrier unit or a floodwater barrier assembly may be located between the second end wall and a next adjacent additional wall. The additional wall or walls are thus "intermediate" the ultimate end walls. Strategic placement of intermediate walls allows floodwater barrier units or a floodwater barrier assembly to incrementally turn and follow a change in direction of a shoreline. Additionally, especially for installations in which a floodwater barrier unit or a floodwater barrier assembly is located on-shore (for example along a levee, riverbank or sea wall construction), use of intermediate walls allows a floodwater barrier unit or a floodwater barrier assembly not to be so lengthy and therefore heavy that raising it for servicing drains or other structures in a recess underneath the floodwater barrier unit or a floodwater barrier assembly becomes overly difficult.

The invention contemplates a method for protecting from flooding a shore adjacent a place for a body of water. In an exemplary embodiment, the method comprises providing, between a pair of walls transverse to a shoreline of the shore, a floodwater barrier unit or a floodwater barrier assembly. The floodwater barrier unit or a floodwater barrier assembly comprising such units includes a panel assembly comprising a flexible resilient panel having one or more watertight chambers of size and arrangement to give the panel water buoyancy and a plurality of rigid attachment members connected to the panel. The floodwater barrier units are attached to a construction along the shoreline by a stationary pivotation member movably joined to a movable pivotation member connected to the panel assembly. The panel assembly is rotatable upwardly about an axis of the pivotation members longitudinal with the construction under the influence of buoyancy and hydrostatic pressure from a rise of the body of waters. The method further comprises providing flexible tension members connected to the panel assembly and positioned to act on the panel assembly to limit rotation of the panel to a predetermined extent.

The buoyant flexible resilient panel in the method may be a flexible panel supported between two elongate rigid attachment members by a plurality of resilient flexible stringers arranged transversely to and connecting to the two elongate rigid attachment members. Alternatively, the flexible resilient panel may be a resiliently elastically deformable panel supported between two elongate rigid attachment members, and may or may not be supported between two the elongate rigid attachment members by a plurality of resilient flexible stringers arranged transversely to and connecting to the two elongate rigid attachment members.

Figure 17:
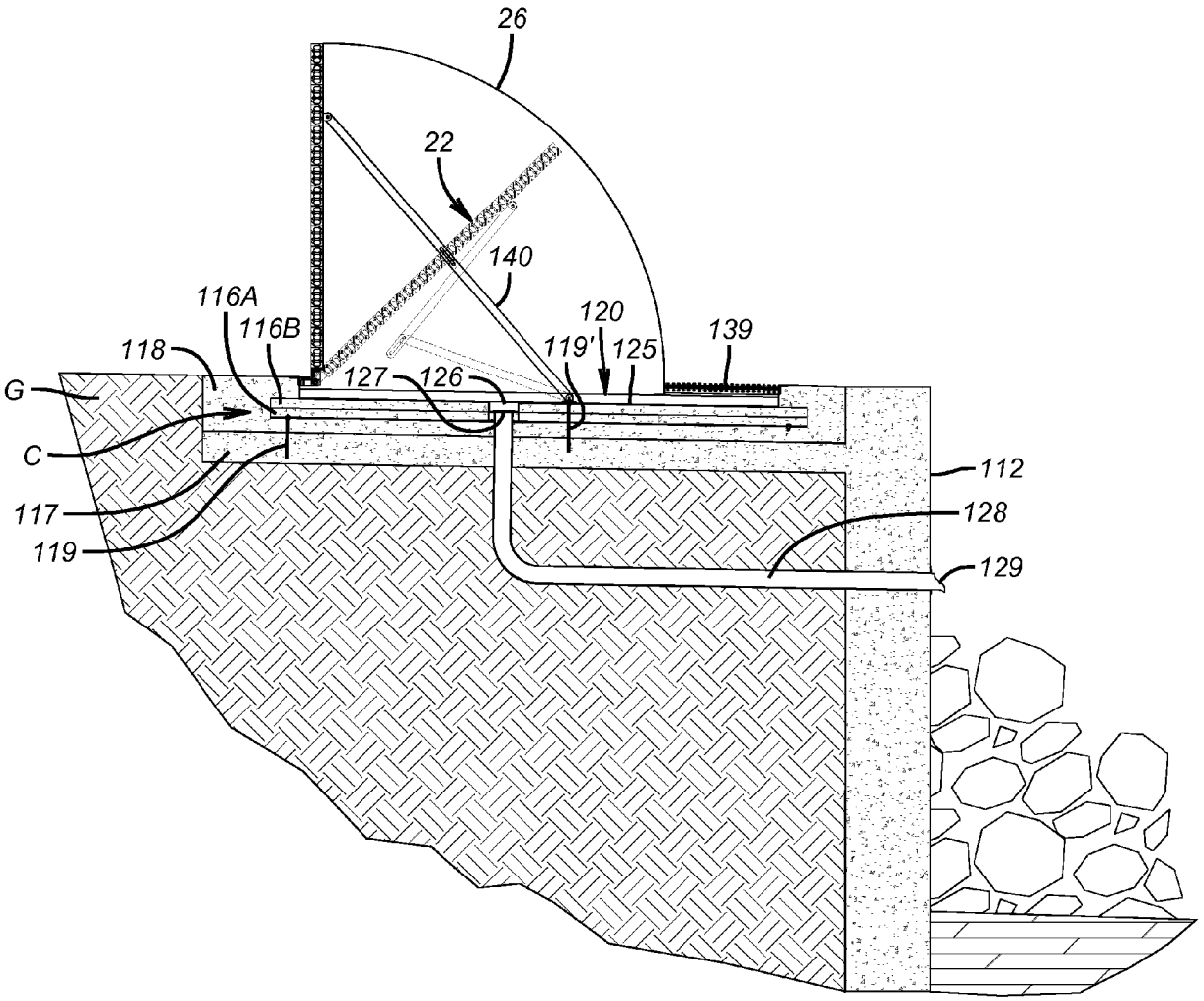
FIG. 17 is a cross sectional view showing an exemplary embodiment of the invention installed on-shore and in an elevating position as would be occasioned by a rise of a body of water above a seawall.

Referring to the drawings, a detailed description of exemplary embodiments of the invention is provided. FIGS. 1-8 illustrate embodiments for an installation in which a longitudinal side-by-side assembly of floodwater barrier units rest on a body of water. FIG. 17 illustrates an embodiment for an on-shore installation. The exemplary embodiments for these installations are installed at a construction "C", for example, a wall "C" (in FIGS. 1, 2, a bulkhead; in FIG. 17, a seawall) lining a shore "S" at a shoreline of a place for a body of water "W".

Referring to FIGS. 1-8, self-actuating floodwater barrier units 22 of a floodwater modules 20, 20' are part of a floodwater barrier assembly 30 installed along a shoreline adjacent a place for a body of water "W", between a pair of walls transverse to the shoreline. Only one of the pair of walls, wall 26, is illustrated in the drawings, but the other wall (sometimes referred to as wall 24, for convenience) is to be understood as like wall 26. Walls 24, 26 may be end walls or an end wall and intermediate wall or a pair of intermediate walls, as explained above. Self-actuating floodwater barrier units 22 (FIGS. 3-8) have a base at a proximal side or end 21 and a top at a distal side or end 23.

Floodwater barrier assembly 30 floats on water "W". The distal top end 23 of a floodwater barrier unit 22 of a module 20 may dip down as water level "W" drops. It can hang down and will still function, buoying upward as water rises from ground "G" to reach top end 23 of a module 20 of floodwater barrier assembly 30. In addition to shore defense against water rising from an adjacent place for a body of water, floodwater barrier assemblies 30 installed at a shoreline with an adequate level of water can provide double duty when in repose: they can make a fishing and diving platform, depending at least in part on the means chosen for resilience for the panel of a floodwater barrier unit 22.

Figure 2:
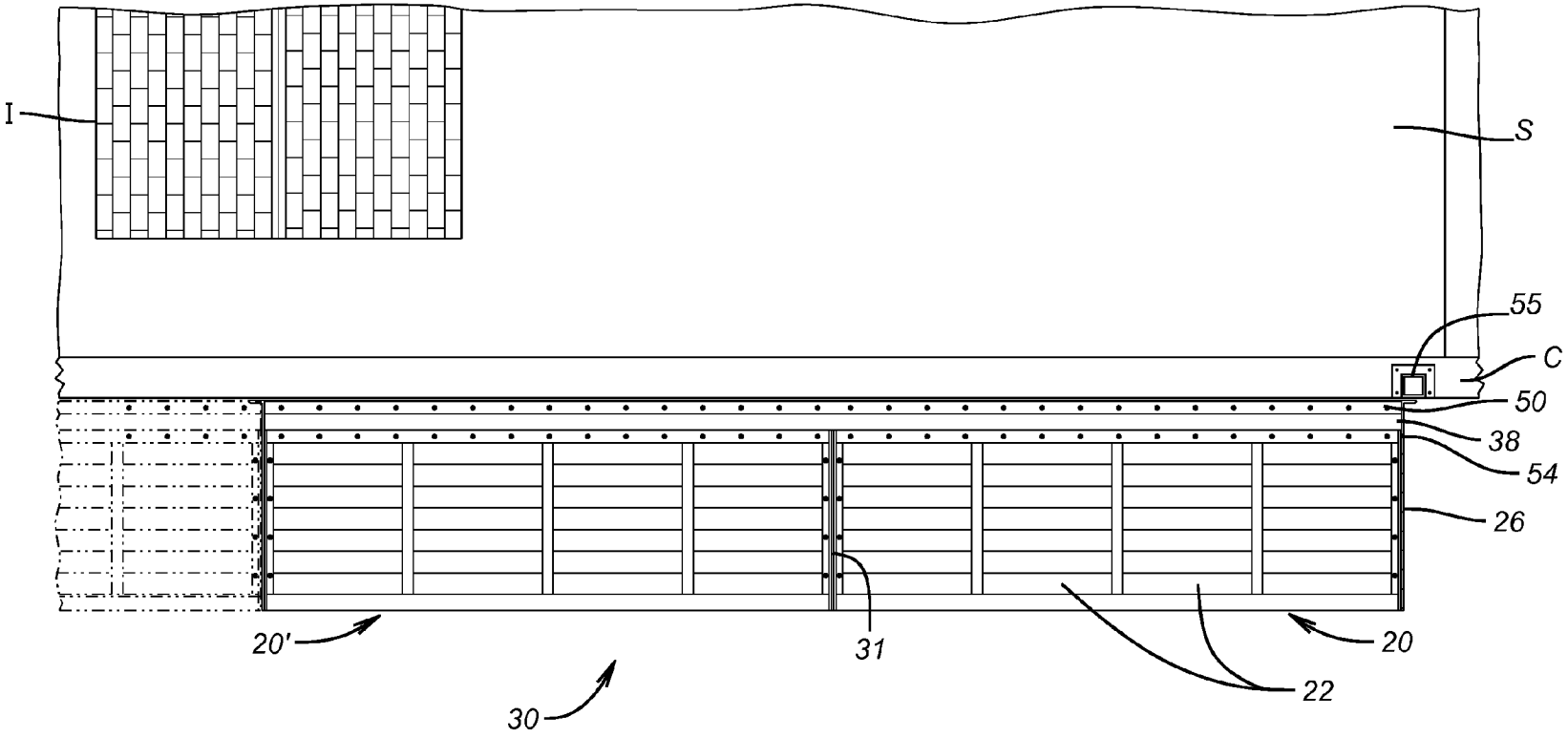
FIG. 2 is a top plan view of the exemplary embodiment of FIG. 1 deployed as in in FIG. 1.
Figure 3:
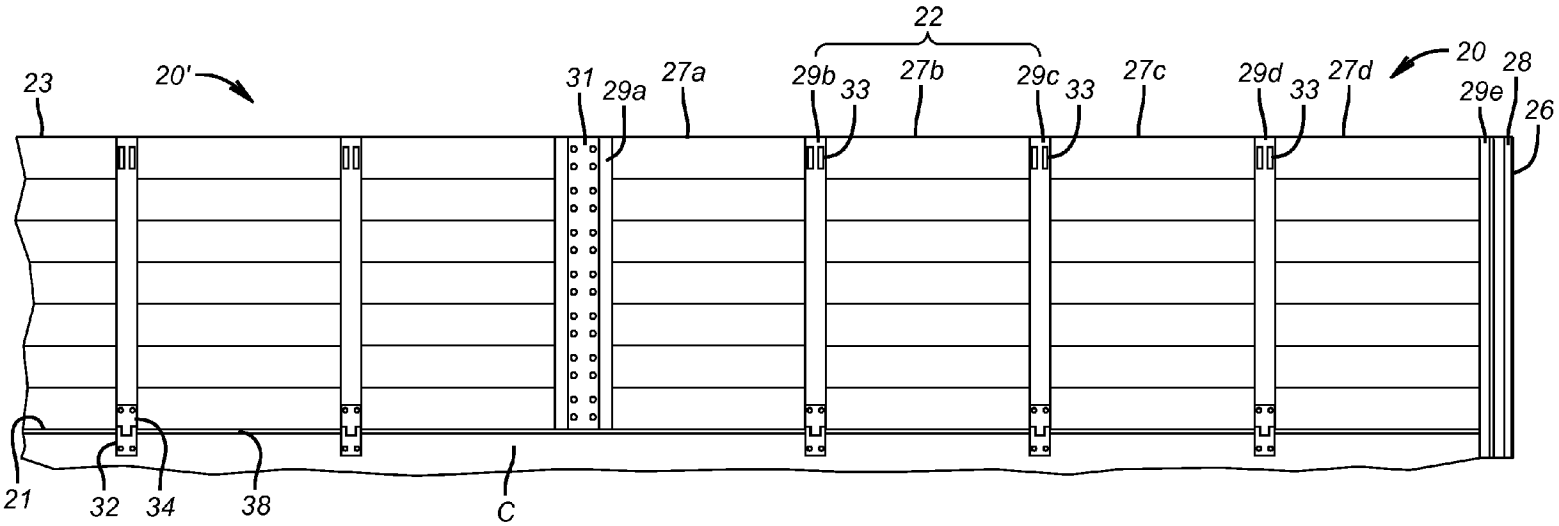
FIG. 3 is an elevational view of the underside (the water facing side) of the a portion of the assembled floodwater barrier embodiment of FIG. 1, that is, the side that contacts the body of water in FIG. 1 when the floodwater barrier is in a normally horizontal disposition floating on the water or when the floodwater barrier raises to an upright position to prevent flooding, as in this view.
Figure 4:
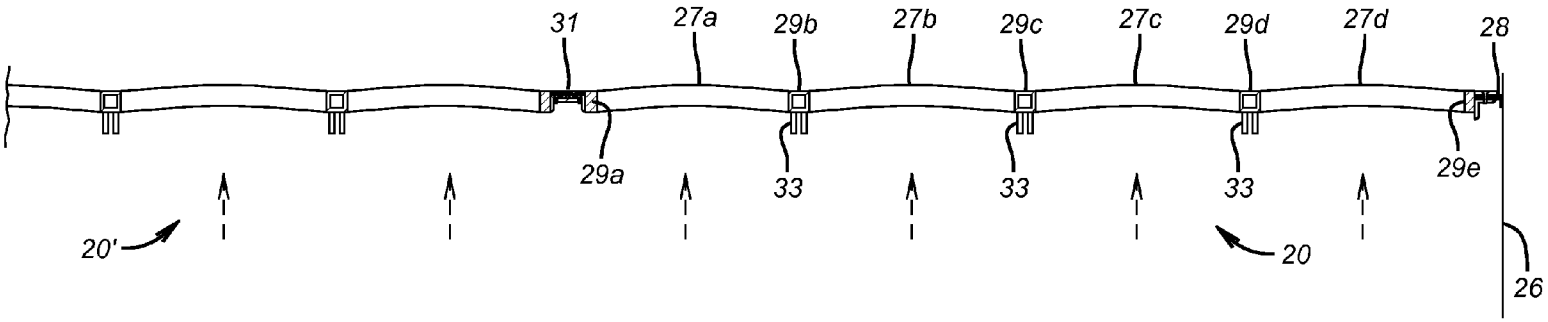
FIG. 4 is a "birds eye" top plan view of the raised floodwater barrier of FIG. 3.

Referring to FIGS. 1 and 2 in particular, a first vertical wall 24 is adapted for connection to the construction, for example, as by a flange 26L outturned at one end of the wall and fastened to a vertical post 55 of construction "C". Similarly, a second vertical boundary wall 24 is adapted for connection to construction "C", as by a like flange 24L (not shown, but mirrors 26L) outturned at an end of wall 24. Wall 24 is suitably spaced from first wall 26 a distance at least as wide as the width of floodwater barrier and in an exemplary embodiment, wider than the width of a floodwater barrier assembly 30 sufficient to provide a gap between each lateral side of the end floodwater barrier unit 22 of a floodwater barrier module 20 and the adjacent boundary wall 24, 26 adequate for accommodation of a flexible lip seal gasket 28 (as described below) for sealing the mentioned gap.

Referring to FIGS. 3, 4 and 5, 6, a basic floodwater barrier unit 22 comprises a flexible resilient panel, such as panel 27*b*, supported by a pair of elongate rigid members, such as elongate rigid members 29*b*, 29*c*. In an exemplary embodiment a floodwater barrier module 20 may comprise a plurality of floodwater barrier units 22 arranged side-by-side, and as exemplified in FIGS. 2, 4 and 5, 6, includes a plurality of flexible resilient panels 27*a*, 27*b*, 27*c* and 27*d*. Each panel is longitudinally supported between elongate rigid members. Flexible resilient panel 27*b* is longitudinally supported between elongate rigid members 29*b*, 29*b*. Flexible resilient panel 27*c* is longitudinally supported between elongate rigid members 29*c*, 29*c*. End flexible resilient panel 27*a* is longitudinally supported between elongate rigid member 29*b* and lateral end elongate hardpoint connector member 29*a*. End flexible resilient panel 27*d* is longitudinally supported between elongate rigid member 29*d* and lateral end elongate hardpoint fixture member 29*e*. Lateral end elongate hardpoint fixture member 29*e* mounts seal gasket 28, further described below. Lateral end elongate hardpoint connector member 29*a* is part of a connection structure 31 for connecting a laterally adjacent floodwater barrier module 20' to a floodwater barrier module 20. Although in FIGS. 4 and 6, the panels 27 (27*a*, 27*b*, et seq.) are shown slightly bowed, this does not indicate that the panels need be actually bowed but instead is merely a schematic device to indicate the panels are flexible and resilient for elastic deformation for water pressure forces in the direction indicted by slight concavity of the bowed panel.

Figure 5:
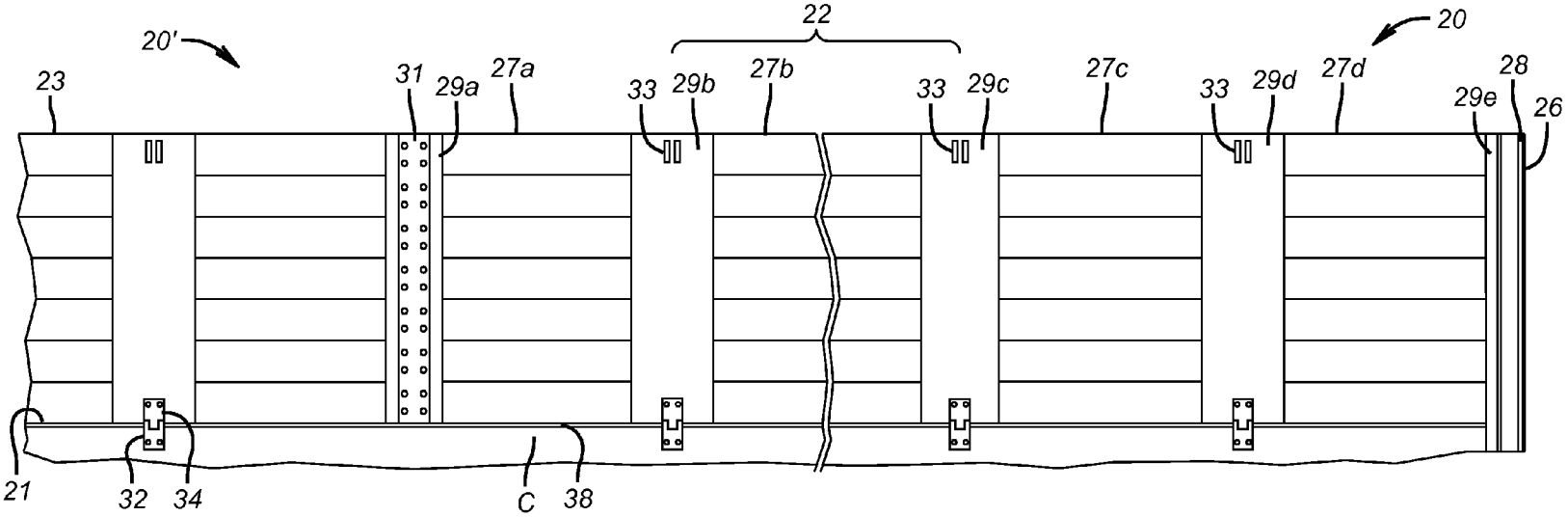
FIG. 5 is the same elevational view as FIG. 3 and depicts a variation of the embodiment of FIG. 3.
Figure 6:
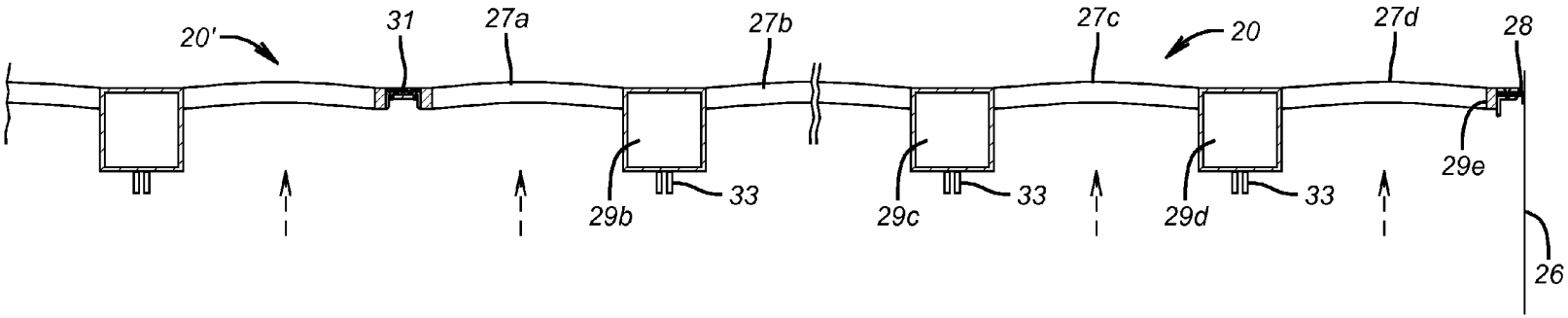
FIG. 6 is a "birds eye" top plan view of the floodwater barrier of FIG. 5

Referring to FIGS. 5, 6, in an exemplary embodiment, some of the rigid members 29 of a floodwater barrier unit 22, e.g., rigid members 29*b*, 29*c* and 29*d*, are hollow and sized relative to the width and weight of panel 27 to aid in the buoyant rise contributed by a panel 27. Each of panels 27 and rigid members 29 are buoyant, contributing a degree of buoyance tailored to tradeoffs (such as shorter or longer panels) at the particular site of an installation. In an exemplary embodiment, a hollow rigid member 29 may be compartmentalized by internal watertight walls transverse to the elongate direction of a panel.

Figure 7:
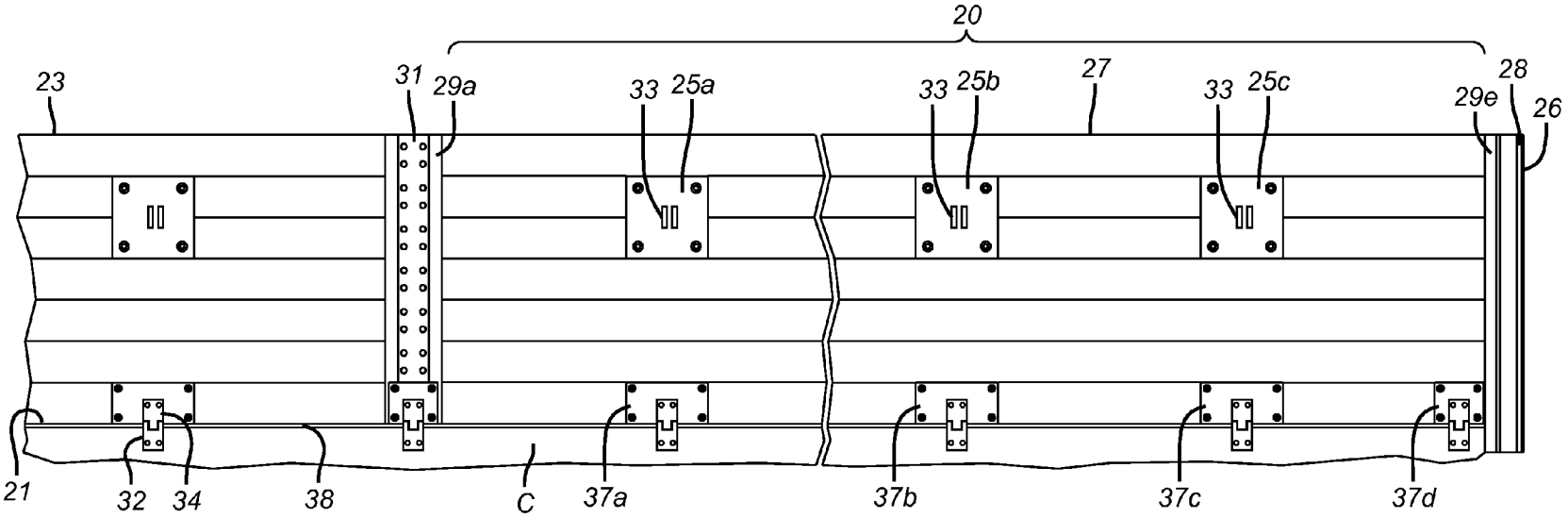
FIG. 7 is the same elevational view as FIG. 3 and depicts an exemplary embodiment alternative to the embodiments of FIGS. 3 and 5.
Figure 8:
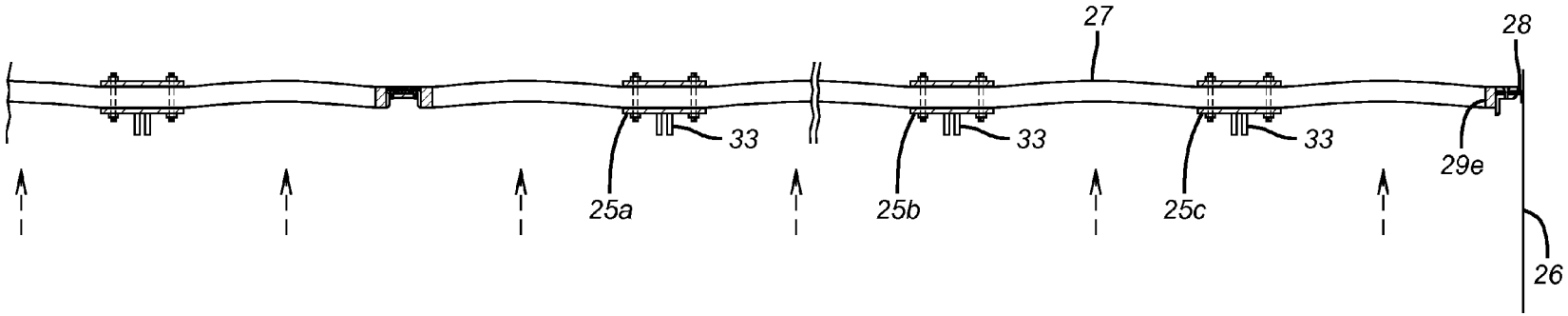
FIG. 8 is a "birds eye" top plan view of the floodwater barrier of FIG. 7.

Referring to FIGS. 7, 8, the same view as in FIGS. 3-6 is presented but in these exemplary embodiments, rigid attachment members of a panel assembly include hardpoints 25 (e.g., 25*a*, 25*b*, 25*c*) and 37 (e.g., 37*a*, 37*b*, 37*c*, 37*d*), in a buoyant flexible resilient panel 27 that are not the elongate hardpoints 29*a* or 29*e* fixed at a lateral side of panel 27; hardpoints 25 serve for attachment of flexible tension members 40 (FIGS. 19-22) limiting rotation of the buoyant flexible resilient panel assembly, and hardpoints 37 serve for attachment of a movable member 34 of pivotation members 32, 34. In FIGS. 7 and 8 the exemplary hardpoints 25 and 37 are rigid attachment members comprising metal plates through bolted across panel 27. Those of ordinary skill in the art will appreciate that hardpoints need not be metal but can be a molded denser and harder polymer formed in a more resilient flexible polymer. In an exemplary embodiment, a module 20 uses hardpoints 25 and 37 for attachments and comprises a longitudinally lengthy flexibly resilient elastically deformable chambered panel structure 27 that does not use resilient flexible stringers for resilience.

Figure 9:
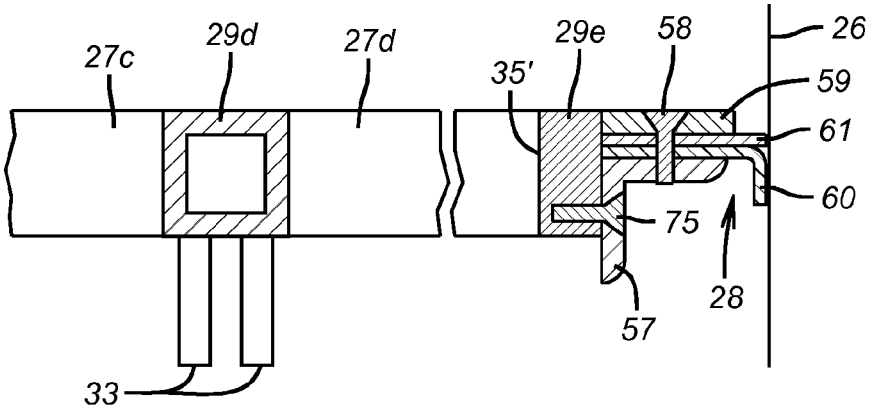
FIG. 9 is a symbolic longitudinal sectional view of an end of a panel of a floodwater barrier unit in an embodiment fitted to contact a wiper wall in which an elongate hardpoint is fixed at a lateral side of the flexible panel.

In an exemplary embodiment, one floodwater barrier unit 22 of module 20 (as in FIGS. 3-6) or a module 20 as in FIGS. 7, 8 is adjacent an end or intermediate wall 26 (or 24) and includes, along a lateral side not joined with another floodwater barrier module 20', at lateral end elongate hardpoint fixture member 29*e*, a gasket 28 positioned to wipe the wall on rise of the floodwater barrier module 20 from horizontal, thereby to restrain passage of water between the floodwater barrier module 20 and the wall 26 (or 24) when the floodwater barrier module 20 pivots upwardly on the pivotation axis. Referring particularly to FIGS. 3-8 for orientation and to FIG. 9 for more detail, flexible lip seal gaskets 28 along a length of a lateral side of floodwater barrier module 20 are of width sufficient to sealingly wipe wall 26 to seal the gap between the lateral side of module 20 and wall 26. Referring to the embodiments of FIGS. 3-6, symbolically represented panel 27*d* of floodwater barrier unit 22 adjacent wall 26 is supported at lateral side 35 by an elongate hardpoint fixture 29*e*. Drilled structural angle member 57 may be affixed to elongate hardpoint fixture 29*e*, as by fastener 75, and if hardpoint fixture 29*e* is metal, suitably by weldment. Secured by bolts 58 holding down and passing through pressure plate 59 into angle member 57 is a lip seal 60 backed by a gasket 61 under pressure plate 59. Lip seal 60 and gasket 61 together comprise lip seal gasket 28 and sealingly contact wall 26 transverse to the shoreline during movement of floodwater barrier module 20 upward along the pivotation axis, and hold the seal when floodwater barrier module 20 is upright.

Although the embodiment depicted in FIGS. 3-8 and 9 includes lip seal gaskets 28, they may be omitted. In a raised floodwater barrier assembly 30 at an end module 20, without the presence of gaskets 28 wiping and sealing the boundary walls 24, 26, a slight vertical slice of water would exist at each lateral edge of the floodwater barrier assembly 30 verses a very large horizontal mass of water refused across the whole face of the f floodwater barrier assembly 30. Depending on the overall width of the floodwater barrier assembly 30, the reduction of water flow onto the shore is orders of magnitude greater than the small slice of water flowing through the margins at the edge of the floodwater barrier assembly 30 adjacent the boundary wall. For protection of a shoreline, such "leakage" at the margins of the floodwater barrier assembly 30 is trivial compared to the protection gained against the large mass of water blocked by the floodwater barrier assembly. Thus, if the lip seals were degraded over time, or even if not present in the first place, most improvements guarded by the floodwater barrier assembly would be sufficiently protected.

Figure 10:
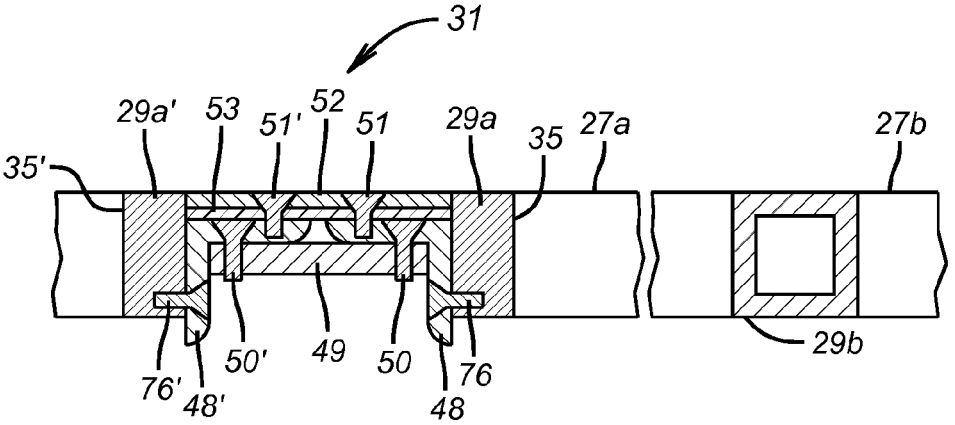
FIG. 10 is a symbolic longitudinal section showing a connector for connecting adjacent panels of floodwater barrier units side-by-side in which an elongate hardpoint is fixed at a lateral side of the flexible panel.

Referring to FIGS. 1-8 for orientation and to FIG. 10 for detail, an exemplary embodiment of a connection member 31 for rigidly connecting adjacent floodwater barrier modules 20, 20' is depicted. As in FIG. 9, panels 27 are symbolically depicted. The lateral left side 35 of panel 27 of floodwater barrier module 20 is supported by an elongate hardpoint fixture 29*a*, and the adjacent lateral right side 35' of panel 27' of floodwater barrier module 20' is supported by an elongate hardpoint fixture 29*a*'. Drilled and tapped structural angle members 48, 48' are affixed respectively to fixtures 29*a*, 29*a*' by fasteners 76, 76' respectively. A pressure plate 49 backing the angle members 48, 48' is fastened to angle members 48, 48' by countersunk bolts 50, 50'. Angle members 48, 48' are also drilled distally from fixtures 29*a*, 29*a*' to receive bolts 51, 51' holding a topside pressure plate 52 to angle members 48, 48'. A gasket 53 is sandwiched between topside pressure plate 52 and angle members 48, 48' secured by topside pressure plate 52 and bolts 51, 51'.

Referring particularly to FIGS. 2, 3, 5, 7, floodwater barrier unit 22 further comprises pivotation members comprising a stationary member 32 for anchorage adjacent the shoreline at construction "C" and a moveable member 34 connected to floodwater barrier unit 22. Stationary pivotation member 32 is connected to construction "C" and a moveable member 34 is moveably joined to the stationary member 32 at a horizontal pivotation axis (not viewable in the illustrations) normal to end or intermediate walls 24, 26. Moveable member 34 is connected to proximal side 21 of floodwater barrier unit 22 in a lower portion of an elongate rigid attachment member 27 or to hardpoint 29 and is pivotable about the mentioned pivotation axis. For an installation in which the panel assembly is normally recumbent on water "W", the connected and joined pivotation members 32, 34 locate the proximal side 21 of floodwater barrier module 20 at a selected elevation "E" spaced from normally inundated ground "G" (see FIG. 1) for pivotation of floodwater barrier module 20 swinging the distal end 23 of the module upwardly on rise of water "W" above elevation "E."

Referring to FIGS. 1, 3, 5 and 7 a flexible strip gasket 38 runs along the width of floodwater barrier module 20 at the proximal side 21 of floodwater barrier module 20 spanning across pivotation members 32, 34. Strip gasket 38 prevents passage of water between the construction "C" and the proximal side 21 of floodwater barrier module 20. Threaded fasteners fasten retention bands 50, 54 over strip 38 securing strip 38 to floodwater barrier unit 22.

Figure 11:
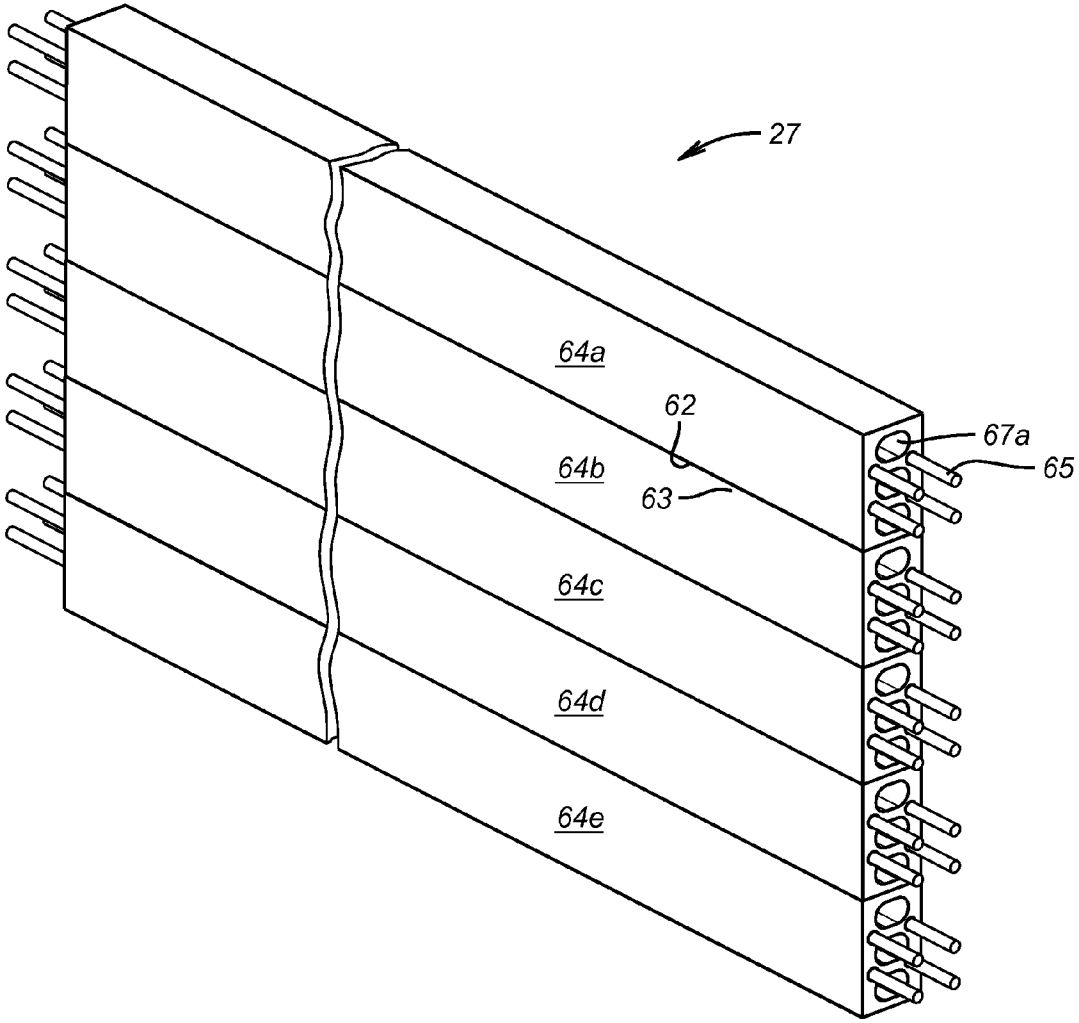
FIG. 11 is a perspective semi-schematic view of an exemplary embodiment of a water buoyant flexible resilient panel of a floodwater barrier unit of a floodwater barrier module such as in FIG. 3 or 5 in which transversely arranged resilient flexible stringers are embedded in a plurality of flexible resilient elastomeric longitudinal tubes united as a buoyant flexible resiliently elastically deformable panel.
Figure 12A:
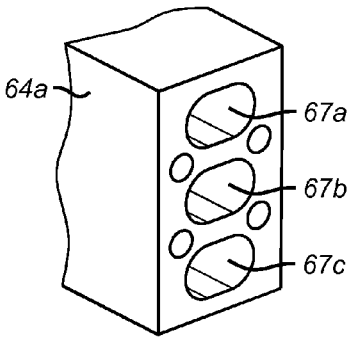
FIG. 12*a* is a perspective semi-schematic sectional view of the water buoyant flexible resilient panel FIG. 11 showing a cutaway of a flexible resilient elastomeric longitudinal tube of FIG. 11, showing sleeves for insertion of resilient flexible stringers of FIG. 11.
Figure 12B:
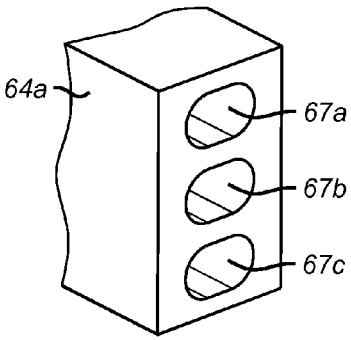
FIG. 12*b* is the same view as FIG. 12*a* for a water buoyant flexible resilient panel that does not have the sleeves of the panel of FIG. 12*a*.
Figure 13:
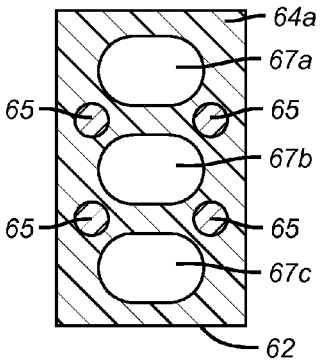
FIG. 13 is a cross sectional semi-schematic sectional view of a panel the same a the panel of FIG. 12*a* but with resilient flexible stringers in provided sleeves.

Turning now to FIGS. 11-13, in an exemplary embodiment, a resilient flexible resilient panel 27 of a floodwater barrier unit comprises a plurality of closed end, longitudinal elastomeric tubes 64*a*, 64*b*, 64*c*, 64*d*, 64*e* united at their upper and lower seams (e.g. 62, 63) to disallow passage of water through the seams between the tubes 64*a*, 64*b*, 64*c*, 64*d*, 64*e*. Hollows 67*a*, 67*b* and 67*c* in tube 64*a*, as exemplary of hollows in tubes 64*b*, 64*c*, 64*d*, 64*e*, are each closed ended providing separate or compartmentalized watertight chambers in tube 64*a*, and the same is true of the hollows in the other tubes 64*b*, 64*c*, 64*d*, 64*e*. By compartmentalizing watertight chambers provided for buoyancy, a floodwater barrier unit comprising the panel 27 retains its water buoyancy if one chamber loses water-tightness. Resiliently flexible stringers 65 are embedded in the elastically deformable material of tubes 64*a*, 64*b*, 64*c*, 64*d*, 64*e*.

Figure 14:
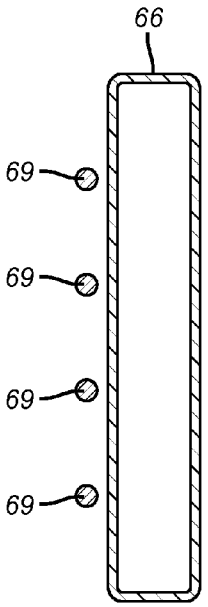
FIG. 14 is a cross sectional view of components in a construction of exemplary embodiments of a water buoyant panel of a floodwater barrier unit shown in FIGS. 15 and 16.
Figure 15:
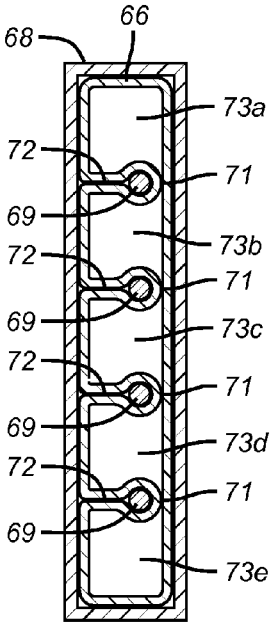
FIG. 15 is another exemplary embodiment of a water buoyant panel of a floodwater barrier unit.
Figure 16:
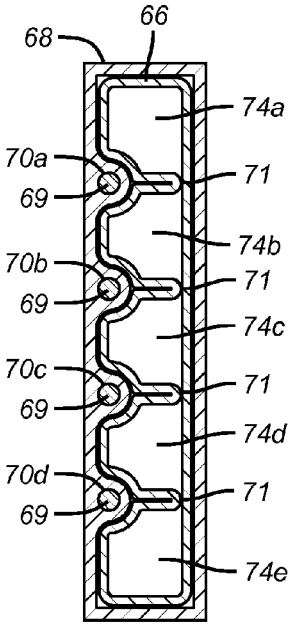
FIG. 16 is another exemplary embodiment of a water buoyant panel of a floodwater barrier unit.

Referring to FIGS. 14-16, in another exemplary embodiment the flexible resilient panel 27 of a floodwater barrier unit 22 comprises a flexible bladder 66 compartmentalized into a plurality of watertight chambers, in FIG. 157 chambers 73*a*, 73*b*, 73*c*, 73*d*, 73*e*, and in FIG. 16, chambers 74*a*, 74*b*, 74*c*, 74*d*, 74*e*, in each embodiment, in turn wrapped in a sealed envelope 68 of a flexible water impervious material. Resiliently flexible stringers 69 are embedded in the bladder as shown in FIG. 15 or are fitted into sleeves 70 fashioned in an envelope 68 as shown in FIG. 16.

The embodiment of FIG. 15 is formed by pressing resiliently flexible stringers 69 into bladder 66 and welding (for example, by heat melting) the material of the interior surface of bladder 66 over an impressed resiliently flexible stringer 69 to an adjacent interior surface of bladder 66 as at 71 and adhering opposed external surfaces of bladder 66 under a stringer 69, as at 72, to form watertight chambers 73*a*, 73*b*, 73*c*, 73*d*, 73*e*.

The embodiment of FIG. 16 is formed by fashioning sleeves 70 in an envelope 68, welding (for example, by heat melting) the material of the interior surface of bladder 66 to an adjacent interior surface of bladder 66 as at 71 to form compartmentalized watertight chambers 74*a*, 74*b*, 74*c*, 74*d*, 74*e* and adhering opposed external surfaces of bladder 66 like in FIG. 15 at 72 but not under a stringer 69 as in FIG. 15; sealingly wrapping compartmentalized bladder 66 in envelope 68, and inserting resiliently flexible stringers 69 into sleeves 70*a*, 70*b*, et seq. of envelope 68.

As used herein, reference to the structure or action of a basic floodwater barrier unit 22 will be understood to apply as well to a floodwater barrier module 20 or to a floodwater barrier 30 comprising an assembly of basic floodwater barrier modules 20 where the same structure or action is merely a repeat of the basic floodwater barrier unit 22.

Floodwater barrier module 20 further comprises flexible tension members positioned to act on floodwater barrier unit 22 to limit upward rotation of floodwater barrier unit 22 or module 20 to a predetermined extent. Referring particularly to FIGS. 1, 4, 6, and 8 in the instance of the embodiments adapted for installation (and shown installed) at a construction "C" adjacent a shoreline of a shore "S" of a place for a body of water "W", a flexible tension member or restraint 40 acting on a floodwater barrier unit 22 and floodwater barrier module 20 prevents floodwater barrier module 20 from rotating about the pivotation axis more than a predetermined extent when floodwater barrier module 20 is rotationally raised upwardly above elevation "E." In the embodiments shown in FIGS. 1, 4, 6, 8, a flexible tension member 40 is illustrated as a chain or cable, suitably connected to an elongate rigid member 29 or a hardpoint 25 of a floodwater barrier unit 22, as at clevis 33 (e.g., FIGS. 4, 6, 8) and anchored as by a piling "A" to the inundated ground "G" of a place for a body of water "W". In the embodiments shown, the predetermined extent is vertical, but more or less than vertical may be permissible in some installations. Flexible tension members 40 hold elongate rigid members 29 or hardpoints 25 fast and allow the flexible and resilient panels to absorb the blows of cyclic wave action. Flexible tension members 40 also provide the advantage of not interfering with or cluttering a view of a body of water by an on-shore observer near the shoreline when floodwater barrier assemblies 30 are reposed in normal horizontal position.

On rise of water "W" sufficient to float a floodwater barrier module 20 or a floodwater barrier 30 above elevation "E", floodwater barrier 30 formed by connected floodwater barrier modules 20 and comprising floodwater barrier units 22 is buoyed and by force of rising water (hydrostatic pressure) is rotated upwardly about the pivotation axis of pivotation members 32, 34. Before floodwater barrier module 20 rotates past about 45 degrees, more of the hydrostatic pressure is "lifting" floodwater barrier module 20. After about 45 degrees, more of the hydrostatic pressure is pushing against the waterside face of floodwater barrier module 20 to raise it. The result is a continuous curve of forces that first balance floodwater barrier module 20 in a partially raised position against gravity pressing floodwater barrier modules 25 against pivotation axis, and that thereafter eventually overcomes the weight of floodwater barrier module 20 and elevates it fully raised to the extent of rotation restrained by tension members 40. The total weight, displacement and size of floodwater barrier module 20 moves the "rotation point" up or down the curve of forces. Floodwater barrier module 20 full elevation is maintained by impress of hydrostatic pressure until the water level subsides and the force of gravity takes over to lower floodwater barrier module 20.

Referring now to FIG. 17, an on-shore installation of an embodiment of a floodwater barrier unit of this invention is illustrated. FIG. 17 is a cross sectional view of a floodwater barrier unit 22. It should be understood that the depiction as well applies to a floodwater barrier module 20, since this view does not show floodwater barrier units 22 assembled to form a floodwater barrier module 20 or a floodwater barrier module 20 connected with another floodwater barrier module 20 to form a floodwater barrier 30.

In FIG. 17, a floodwater barrier unit 22 is housed in a pan 120 recessed in the construction C. Pan 120 is between end walls 24, 26 (only wall 26 is seen in this sectional elevation). Pan 120 is anchored to a concrete foundation comprising a lower, first pour seal slab 117 and a second pour slab 118 in ground G on the shore side of seawall 112. Horizontal channels 116A tee from vertical flanges 116B fixed the bottom of pan 120. Channels 116A fill with concrete and embed in upper slab 18 in the second pour, providing anchors 116 running normal to a pivotation axis as the axis is described above. This is parallel to the shoreline. Channel 116A set hardened in upper slab 118 is further anchored to lower first pour slab 117 by anchor bolts 119.

Floodwater barrier unit 22 when upright resists the full hydrostatic pressure from a mass of floodwater that, acting on floodwater barrier unit 22 would tend to lever pan 120 from ground 8 in the direction of flow of the floodwater. The pan anchors 116A and 116B in second slab 118 running parallel to an expected direction of floodwater assaulting floodwater barrier unit 22 provides greater resistance to those leveraging forces than would the same anchors running parallel to the pivotation axis. Floodwater barrier unit 22 is kept vertical against the floodwaters by flexible (flexible in the sense of foldable on a hinge pin) tensioning members or retention arms 140. Retention arms 140 are anchored to the bottom of pan 120, and pan 120 is additionally anchored against the floodwaters leverage, by anchor bolts 119' that extend into the lower seal pour concrete slab 117 from retention arm anchor pan mounts secured to the bottom of pan 120. Suitably, lower seal slab 118 in ground G is tied into seawall 112, by well-known means, such as by dowels. The particular manner in which pan 120 is secured to ground G will vary by site, and the manner shown is exemplary and non-exclusive. With flexible tensioning members or retention arms 140 employed to restrain floodwater barrier unit 22 from rising past an erect vertical position, the manner of anchoring pan 120 should be robust enough to withstand the force of flooding waters pressing against floodwater barrier unit 22 in its erect position.

Still referring to FIG. 17, pan 120 includes a pan drainage system comprising one or more horizontal troughs 126 draining into one or more openings 127 for connection to one or more passages 128 to outlets 129 on the seaside of seawall 112. Outlets 129 are lower in elevation than opening(s) 127 in pan 20. Ordinarily, outlets 129 will be higher than the normal high tide on the seaside of seawall 112. In this exemplary embodiment, trough 26 is substantially parallel to the pivotation axis described below. A purpose of troughs 126, openings 127, passages 128 and outlets 129 is to drain water back to the sea side of seawall 112 after flooding waters have receded and the water level on the sea side of seawall 112 is lower than outlets 129. When water against the waterside face of the floodwater barrier unit 22 recedes, the force holding floodwater barrier unit 22 vertical is reduced, and moments of the force of gravity begin to grow in a direction normal to the shore side face of floodwater barrier unit 22. Hydrostatic pressure yields to buoyancy forces in opposition to gravity, until eventually, the gate resumes its horizontal position in the recess.

Another purpose of troughs 126, openings 127, passages 128 and outlets 129 is to preload the pan drainage system to potentiate elevation of floodwater barrier unit 22 as a result of collection and impound of overtopping waves smashing against seawall 112. During a violent wind storm such as a hurricane or tropical storm where the peaks of waves are breaking over the seawall 112, if the troughs of the breaking waves are higher than outlets 129, water can course from openings 129 upwards through passages 128 and potentially into pan 120 depending on the relative elevation of the wave troughs above outlets 129. This will prevent drainage of water from pan 120 through openings 127 and passages 128 to the sea side of seawall 112 and will load pan 120 to prime rise of floodwater barrier unit 22. The cross sectional areas of the openings 127, passages 128 and outlets 129 can be adjusted for a particular construction C to increase or retard the passage of water therein and therethrough to fine tune the rise of water in pan 120 so as not to raise the floodwater barrier unit 22 earlier than may be desired in a particular location. Pan 120 may be slightly sloped toward seawall 112 to facilitate drainage.

A plurality of support pan beams 125 traverse the bottom of pan 120 from back to front spanning over trough 126. Pan beams 125 contribute to support of buoyant floodwater barrier unit 22 when floodwater barrier unit 22 is horizontally disposed in pan 120. Floodwater barrier unit 22 in repose occupies pan 120 above a clearance space between support pan beams 125 except a portion at the fore end of pan 120. The fore end portion opens upwardly providing an entrance through which flooding water breaking seawall 112 is admitted into pan 120. This entrance is guarded by a grate 139 atop the entrance. Water admitted through grate 139 into the entrance runs into the unoccupied portions of the clearance spaces between support pan beams 125.

On rise of water "W" sufficient to float a floodwater barrier module 20 or a floodwater barrier 30 above elevation "E", floodwater barrier 30 formed by connected floodwater barrier modules 25 comprised of assembled floodwater barrier units 22 is buoyed upwardly by water admitted into and rising in pan 120 then above pan 120 and is rotated upwardly about the axis of pivotation members 32, 34. Before floodwater barrier module 20 rotates past about 45 degrees, more of the hydrostatic pressure is "lifting" floodwater barrier module 20. After about 45 degrees, more of the hydrostatic pressure is pushing against the waterside face of floodwater barrier module 20 to raise it further. The result is a continuous curve of forces that first balance floodwater barrier module 20 in a partially raised position against gravity pressing floodwater barrier modules 25 against the pivotation axis, and that thereafter eventually overcomes the weight of floodwater barrier module 20 and elevates it fully raised to the extent of rotation restrained by tension arm members 140. The total weight, displacement and size of floodwater barrier module 20 moves the "rotation point" up or down the curve of forces. Floodwater barrier module 20 in full elevation is maintained there by impress of hydrostatic pressure until the water level subsides and the force of gravity takes over to lower floodwater barrier module 20.

The above-disclosed subject matter is to be considered illustrative, and not restrictive. The appended claims are intended to cover all modifications, enhancements, and other embodiments that fall within the true scope of the present invention. To the maximum extent allowed by law, the present invention is to be determined by the broadest permissible interpretation of the following claims and their equivalents, unrestricted or limited by the foregoing detailed descriptions of exemplary embodiments of the invention.

I claim:

1. A self-actuating floodwater barrier unit for installation along a shoreline adjacent a place for a body of water, between a pair of walls transverse to the shoreline, comprising:

a. a panel assembly comprising a flexible resilient panel and a plurality of rigid attachment members connected to said panel, said flexible resilient panel comprising one or more watertight chambers of size and arrangement to give said panel assembly water buoyancy;

b. pivotation members comprising a stationary member for anchorage adjacent the shoreline and a moveable member connected to a said rigid attachment member on a lower portion of said panel assembly, the moveable member being moveably joined to said stationary member and pivotally rotatable upward from a normally horizontal disposition of the flexible resilient panel about an axis longitudinal with said shoreline under the influence of water buoyancy and hydrostatic pressure from a rise of said body of water; and c. a flexible tension member connected at one end to an anchorage lower than said panel assembly when the panel assembly is horizontally disposed and at the other end connected to a said rigid attachment member at a position on said panel assembly effective to limit upward rotation of the panel assembly to a predetermined extent.

2. The floodwater barrier unit of claim 1 in which said rigid attachment members include at least one elongate rigid attachment member radially transverse to said axis.

3. The floodwater barrier unit of claim 2 in which said at least one elongate rigid attachment member is an elongate hardpoint fixed at a lateral side of said flexible panel.

4. The floodwater barrier unit of claim 3 adjacent one wall of said pair of walls and including, at a lateral elongate hardpoint not connected to another floodwater barrier unit, a gasket mounted on said lateral elongate hardpoint and positioned to wipe said one wall of said pair of walls on rise of said panel assembly from horizontal, to restrain passage of water between the panel assembly and the wall when said panel assembly pivots upwardly on said axis.

5. The floodwater barrier unit of claim 2 in which a said flexible resilient panel is supported between two said elongate rigid attachment members.

6. The floodwater barrier unit of claim 5 in which said flexible resilient panel is a flexible panel supported between said two elongate rigid attachment members by a plurality of resilient flexible stringers arranged transversely to and connecting to said elongate rigid attachment members.

7. The floodwater barrier unit of claim 6 wherein said resiliently flexible stringers are a fiber-reinforced polymer composite or spring steel.

8. The floodwater barrier unit of claim 6 in which an elongate rigid attachment member cooperating with another such member of said two elongate rigid attachment members supporting said flexible panel also attaches a plurality of resilient flexible stringers of a laterally adjacent floodwater barrier unit in which a flexible resilient panel is a flexible panel supported between two elongate rigid attachment members radially transverse to said axis, cooperating with such elongate rigid attachment member of said adjacent unit to support the flexible panel of the adjacent unit.

9. The floodwater barrier unit of claim 8 in which said elongate rigid attachment member is an elongate hardpoint fixed at a lateral side of said flexible panel.

10. A plurality of floodwater barrier units of claim 9 connected side by side at said lateral elongate hardpoints to form a floodwater barrier assembly.

11. A floodwater barrier assembly of claim 10 adjacent a wall of said pair of walls and including, at a lateral elongate hardpoint not connected to another floodwater barrier unit, a gasket mounted on said lateral elongate hardpoint and positioned to wipe the wall on rise of the panel assembly from horizontal, to restrain passage of water between the panel assembly and the wall when said panel assembly pivots upwardly on said axis.

12. A floodwater barrier assembly of claim 10 in which said pair of walls transverse to the shoreline are first and second end walls, and at least one additional wall is transverse to the shoreline and located between said end walls, a first such assembly being located between the first end wall and a next adjacent additional wall, and a second such assembly being located between said second end wall and a next adjacent additional wall.

13. The floodwater barrier assembly of claim 10 in which said panel assembly is arranged to float on a body of water when normally horizontally disposed.

14. The floodwater barrier assembly of claim 10 in which said panel assembly is arranged to reside in a recess on the shore along the shoreline normally horizontally disposed.

15. The floodwater barrier unit of claim 5 in which said flexible resilient panel is resiliently elastically deformable.

16. The floodwater barrier unit of claim 15 in which said flexible resiliently elastically deformable panel comprises a water impervious thermoplastic elastomer, rubber composition or elastomeric laminate material, or a combination or composite of two or more thereof.

17. The floodwater barrier unit of claim 15 in which said flexible resiliently elastically deformable panel comprises a plurality of closed end, united, elastomeric longitudinal tubes arranged generally parallel to said axis of panel rotation.

18. The floodwater barrier unit of claim 15 in which said flexible resiliently elastically deformable panel comprises a bladder compartmentalized into a plurality of said watertight chambers and encased in a sealed envelope of wear resistant material.

19. The floodwater barrier unit of claim 15 in which said flexible resiliently elastically deformable panel is supported between said two elongate rigid attachment members by a plurality of resilient flexible stringers arranged transversely to and connecting to said elongate rigid attachment members.

20. The floodwater barrier unit of claim 19 wherein said resiliently flexible stringers are a fiber-reinforced polymer composite or spring steel.

21. The floodwater barrier unit of claim 19 wherein said resiliently flexible stringers are embedded in said flexible resiliently elastically deformable panel.

22. The floodwater barrier unit of claim 19 in which said resiliently flexible stringers are fitted into sleeves fashioned in said flexible resiliently elastically deformable panel.

23. The floodwater barrier unit of claim 19 in which an elongate rigid attachment member cooperating with another such member of said two elongate rigid attachment members supporting said flexible panel also attaches a plurality of resilient flexible stringers of a laterally adjacent floodwater barrier unit in which a flexible resilient panel is a flexible panel supported between two elongate rigid attachment members radially transverse to said axis, cooperating with such elongate rigid attachment member of said adjacent unit to support the flexible panel of the adjacent unit.

24. The floodwater barrier unit of claim 23 in which said elongate rigid attachment member is an elongate hardpoint fixed at a lateral side of said flexible panel.

25. A plurality of floodwater barrier units of claim 24 connected side by side at said lateral elongate hardpoints to form a floodwater barrier assembly.

26. A floodwater barrier assembly of claim 25 adjacent a wall of said pair of walls and including, at a lateral elongate hardpoint not connected to another floodwater barrier unit, a gasket mounted on said lateral elongate hardpoint and positioned to wipe the wall on rise of said panel assembly from horizontal, to restrain passage of water between the panel assembly and the wall when said panel assembly pivots upwardly on said axis.

27. A floodwater barrier assembly of claim 25 in which said pair of walls transverse to the shoreline are first and second end walls, and at least one additional wall is transverse to the shoreline and located between said end walls, a first such assembly being located between the first end wall and a next adjacent additional wall, and a second such assembly being located between said second end wall and a next adjacent additional wall.

28. The floodwater barrier assembly of claim 25 in which said panel assembly is arranged to float on a body of water when normally horizontally disposed.

29. The floodwater barrier assembly of claim 25 in which said panel assembly is arranged to reside in a recess on the shore along the shoreline normally horizontally disposed.

30. The floodwater barrier unit of claim 5 in which: said rigid attachment members include hardpoints in said flexible panel not a said elongate hardpoint fixed at a lateral side of the panel; a said tension member is connected to a hardpoint in an upper portion of said flexible panel not a said elongate hardpoint fixed at a lateral side of the panel; and said moveable pivotation members are connected to hardpoints in lower portions of said flexible panel that are not said at least one elongate hardpoint fixed at a lateral side of the panel.

31. The floodwater barrier unit of claim 30 in which said flexible panel is resiliently elastically deformable.

32. The floodwater barrier unit of claim 31 in which said flexible resiliently elastically deformable panel comprises a water impervious thermoplastic elastomer, rubber composition or elastomeric laminate material, or a combination or composite of two or more thereof.

33. The floodwater barrier unit of claim 31 in which said flexible resiliently elastically deformable panel comprises a plurality of closed end, unitarily combined, elastomeric longitudinal tubes arranged generally parallel to said axis.

34. The floodwater barrier unit of claim 31 in which said flexible resiliently elastically deformable panel comprises a bladder compartmentalized into a plurality of watertight chambers and encased in an envelope of wear resistant material.

35. The floodwater barrier unit of claim 30 in which in which said at least one elongate rigid attachment member is an elongate hardpoint fixed at a lateral side of said flexible panel.

36. A plurality of floodwater barrier units of claim 35 connected side by side at said lateral elongate hardpoints to form a floodwater barrier assembly.

37. A floodwater barrier assembly of claim 36 adjacent a said wall and including, at a lateral elongate hardpoint not connected to another floodwater barrier unit, a gasket mounted on said hardpoint and positioned to wipe the wall on rise of said panel assembly from horizontal, to restrain passage of water between the panel assembly and the wall when the panel assembly pivots upwardly on said axis.

38. The floodwater barrier assembly of claim 36 in which said pair of walls transverse to the shoreline are first and second end walls, and at least one additional wall is transverse to the shoreline and located between said end walls, a first such assembly being located between the first end wall and a next adjacent additional wall, and a second such assembly being located between said second end wall and a next adjacent additional wall.

39. The floodwater barrier unit assembly of claim 36 in which said panel assembly is arranged to float on a body of water when normally horizontally disposed.

40. The floodwater barrier unit assembly of claim 36 in which said panel assembly is arranged to reside in a recess on the shore along the shoreline normally horizontally disposed.

41. The floodwater barrier unit of claim 1 in which one or more of said one or more chambers are compartmentalized.

42. The floodwater barrier unit of claim 2 in which said one or more of said elongate rigid attachment members include within them one or more watertight chambers.

43. The floodwater barrier unit of claim 42 in which one or more of said one or more chambers are compartmentalized.

44. A method for protecting a shore adjacent a place for a body of water from flooding, comprising:

a. providing a plurality of laterally connected floodwater barrier units between a pair of walls transverse to a shoreline of the shore, said floodwater barrier units each comprising a panel assembly comprising a flexible resilient panel having one or more watertight chambers of size and arrangement to give the panel assembly water buoyancy and a plurality of rigid attachment members connected to said panel, said panel assembly being attached to a construction along the shoreline by a stationary pivotation member moveably joined to a moveable pivotation member connected to a lower portion of said panel assembly, said panel assembly being rotatable upwardly about an axis of the pivotation members longitudinal with said construction under the influence of buoyancy and hydrostatic pressure from a rise of said body of water, and b. providing flexible tension members connected to a portion of said panel assembly and positioned to act on said panel assembly effective to limit rotation of the panel to a predetermined extent.

45. The method of claim 44 in which said flexible panel is supported between two said elongate rigid attachment members by a plurality of resilient flexible stringers arranged transversely to and connecting to said two elongate rigid attachment members.

46. The method of claim 44 in which said flexible resilient panel is resiliently elastically deformable.

47. The method of claim 46 in which said flexible resiliently elastically deformable panel is supported between two said elongate rigid attachment members by a plurality of resilient flexible stringers arranged transversely to and connecting to said two elongate rigid attachment members.

* * * * *